US005671628A

United States Patent [19]

Halila et al.

[11] Patent Number: 5,671,628

[45] Date of Patent: Sep. 30, 1997

[54] LASER SHOCK PEENED DIES

[75] Inventors: Herbert Halila; Seetharamaiah Mannava, both of Cincinnati, Ohio

[73] Assignee: General Electric Company, Cincinnati, Ohio

[21] Appl. No.: 573,849

[22] Filed: Dec. 18, 1995

[51] Int. Cl.[6] ..... C21D 7/06; C22C 14/00

[52] U.S. Cl. ..... 72/53; 29/90.7; 148/525; 219/121.68; 219/121.69

[58] Field of Search ..... 72/53; 29/90.7; 148/525; 219/121.68, 121.69

[56] References Cited

U.S. PATENT DOCUMENTS

| | | | |
|---|---|---|---|
| 3,850,698 | 11/1974 | Mallozzi et al. . | |
| 4,002,403 | 1/1977 | Mallozzi et al. . | |
| 4,060,769 | 11/1977 | Mallozzi et al. . | |
| 4,401,477 | 8/1983 | Clauer et al. . | |
| 4,581,913 | 4/1986 | Reed | 72/53 |
| 4,937,421 | 6/1990 | Ortiz, Jr. et al. . | |
| 5,127,019 | 6/1992 | Epstein et al. . | |
| 5,131,957 | 7/1992 | Epstein et al. . | |
| 5,306,360 | 4/1994 | Bharti et al. . | |
| 5,409,415 | 4/1995 | Kawanami et al. . | |

FOREIGN PATENT DOCUMENTS

| | | | |
|---|---|---|---|
| 58904 | 4/1983 | Japan | 72/53 |
| 1424890 | 9/1988 | U.S.S.R. | 72/53 |

OTHER PUBLICATIONS

"Laser shocking extends fatigue life", by John A. Vaccari, American Machinist, A Penton Publication, Jul. 1992, pp. 62–64.

"Effects Of Laser Induced Shock Waves On Metals", by Clauer, Holbrook and Fairans, Chapter 38, pp. 675–702.

"Laser Shock Processing Increases the Fatigue Life of Metal Parts", Materials and Processing Report, Sep. 1991, pp. 3–5.

*Primary Examiner*—David Jones

*Attorney, Agent, or Firm*—Andrew C. Hess; Nathan D. Herkamp

[57] ABSTRACT

A die having a metallic block with a depression, the depression having at least one cross-sectional transition zone, at least one laser shock peened surface encompassing at least a portion of the zone, a region having deep compressive residual stresses imparted by laser shock peening (LSP) extending into the airfoil from the laser shock peened surface. The die has been found to be useful for cold rolling blanks such when the metallic block is a cold rolling die block. The die may be adapted for forming a gas turbine engine component, such as a compressor blade, having an airfoil such that the depression corresponds to the airfoil.

6 Claims, 4 Drawing Sheets

12

14

LASER SHOCK PEENED DIES

RELATED PATENT APPLICATIONS

The present Application deals with related subject matter in U.S. Pat. Nos. 5,492,447, entitled "LASER SHOCK PEENED ROTOR COMPONENTS FOR TURBOMACHINERY", 5,591,009, entitled "LASER SHOCK PEENED GAS TURBINE ENGINE FAN BLADE EDGES", and Ser. No. 08/362,362, entitled "ON THE FLY LASER SHOCK PEENING".

BACKGROUND OF THE INVENTION

1. Field of the Invention

This invention relates to pinch and roll dies and, more particularly, to dies having localized compressive residual stresses imparted by laser shock peening along transition areas of the dies.

2. Description of Related Art

Among the many processes used to form metal parts, such as compressor blades for gas turbine engines, is pinch and rolling which uses dies to form an article from a metallic blank by applying pressure to the blank so that it will conform to the hollows of the dies. Cold forming or rolling dies have limited lives due to surface cracking.

This failure mechanism is low cycle fatigue structural failure, particularly, at cross-sectional transition zones where the shape of the variable cross-section changes particularly where there is a rapid change in the cross-section of the dies shape. Typically, in a cold rolling compressor blade die this can occur along areas corresponding to longitudinally extending areas along leading and trailing edges of the airfoil and transversely extending areas corresponding to the base of the airfoil.

This cyclic peak level stressing fatigues the die thus limiting its useful life. It is expensive to refurbish and/or replace the dies and, therefore, any means to enhance and extend the useful life of the dies is very desirable. Several successive roll passes are used to progressively form the workpiece such as the compressor blade exemplified in this patent application. A different set of die blocks are used for each pass and thus quality is more difficult to maintain because of the additional degree of variability introduced by more frequent changing and/or refurbishment of the different sets of die blocks. The present invention is directed towards this end and provides dies with regions of deep compressive residual stresses imparted by laser shock peening along transition area of the dies.

The region of deep compressive residual stresses imparted by laser shock peening of the present invention is not to be confused with a surface layer zone of a work piece that contains locally bounded compressive residual stresses that are induced by a hardening operation using a laser beam to locally heat and, thereby, harden the work piece such as that which is disclosed in U.S. Pat. No. 5,235,838, entitled "Method and Apparatus for Truing or Straightening Out of True Work Pieces". The present invention uses multiple radiation pulses from high power pulsed lasers to produce shock waves on surface of transition area of forging dies using methods similar to those disclosed in U.S. Pat. No. 3,850,698, entitled "Altering Material Properties"; U.S. Pat. No. 4,401,477, entitled "Laser Shock Processing"; and U.S. Pat. No. 5,131,957, entitled "Material Properties" Laser peening as understood in the art and as used herein means utilizing a laser beam from a laser beam source to produce a strong localized compressive force on a portion of a surface. Laser peening has been utilized to create a compressively stressed protection layer at the outer surface of a workpiece which is known to considerably increase the resistance of the workpiece to fatigue failure as disclosed in U.S. Pat. No. 4,937,421, entitled "Laser Peening System and Method". However, the prior art does not disclose laser shock peening transition areas of forging dies to counter cyclic peak tensile stress concentrations below the surface of the dies of the type claimed by the present patent nor the methods of how to produce them. It is to this end that the present invention is directed.

SUMMARY OF THE INVENTION

A die having a metallic block with a depression, the depression having at least one cross-sectional transition zone, at least one laser shock peened surface encompassing at least a portion of the zone, a region having deep compressive residual stresses imparted by laser shock peening (LSP) extending into the metallic block from the laser shock peened surface. The die has been found to be useful for cold rolling blanks. Such a die has what is referred to herein as a cold rolling die block.

A more particular embodiment of the die of the present invention includes first and second laser shock peened surfaces encompassing at least portions of corresponding first and second cross-sectional transition zones, each of the zones located along one of opposite longitudinally extending edges of the depression, and first and second regions having deep compressive residual stresses imparted by laser shock peening (LSP) extending into the airfoil from the first and second laser shock peened surfaces. A third laser shock peened surface may be located along a transverse portion of the die between the longitudinally extending edges of the depression, the third laser shock peened surface encompassing at least a portion of a corresponding third cross-sectional transition zone, and a third region having deep compressive residual stresses imparted by laser shock peening (LSP) extending into the airfoil from the third laser shock peened surface.

The die may be adapted for forming a gas turbine engine component, such as a compressor blade, having an airfoil and the depression corresponds to an airfoil having longitudinally spaced apart airfoil base and tip which are transversely disposed between opposite longitudinally extending leading and trailing edges. The opposite longitudinally extending edges of the die correspond to the leading and trailing edges and the transverse portion corresponds to the base. This die is particularly useful for compressor blades for which the metallic block is a cold rolling die block.

ADVANTAGES

Among the advantages provided by the present invention is the ability to provide long life dies and in particular cold rolling dies which can better withstand fatigue failure due to cyclical peak level stressing. By extending the useful life of dies the invention reduces manufacturing costs related to refurbishing and/or replacing the dies. The present invention provides dies with regions of deep compressive residual stresses imparted by laser shock peening along transition areas of dies where tensile stresses are concentrated during cyclical peak level stressing and which areas are subject to fatigue failure and which often are the first cause for scrapping or refurbishing the die. The present invention also helps produce a more consistent process with less variability from one blade to another and, therefore, a higher quality blade. Several successive roll passes are used to progressively form the workpiece such as a compressor blade and the decrease in variability lowers the number of different sets of die blocks are used for each pass and thus quality is easier to maintain. This also reduces costs because less frequent changing and/or refurbishment of the different sets of die blocks are required as well as a smaller number in inventory.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
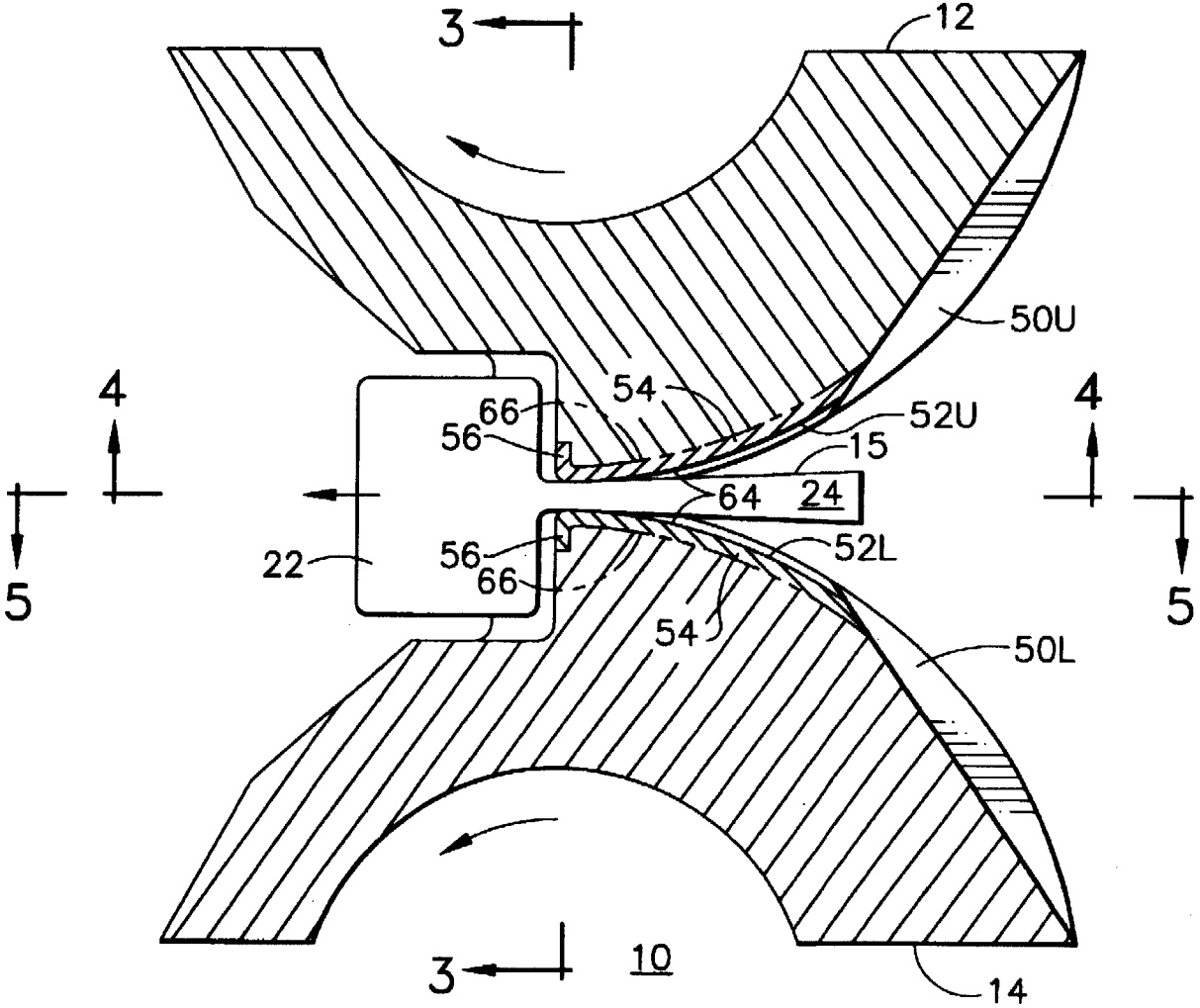
FIG. 1 is an exemplary cross-sectional elevated view of a cold rolling die, in accordance with the present invention, illustrating how it can be used to form the airfoil of the blade illustrated in FIG. 1A.
Figure 1A:
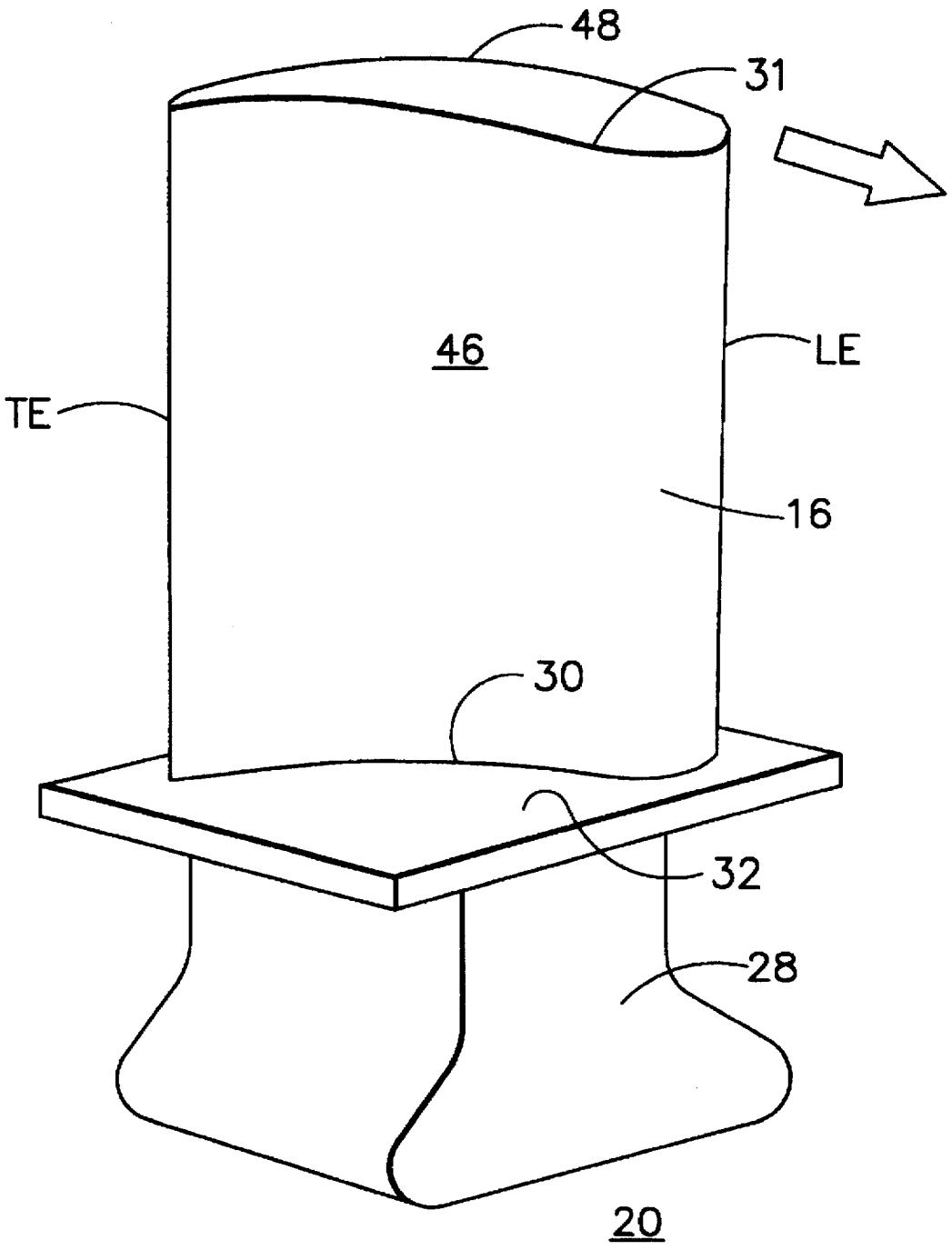
FIG. 1A (PRIOR ART)
FIG. 1A is perspective illustrative view of an exemplary aircraft gas turbine engine compressor blade typically found in the prior art.
Figure 2:
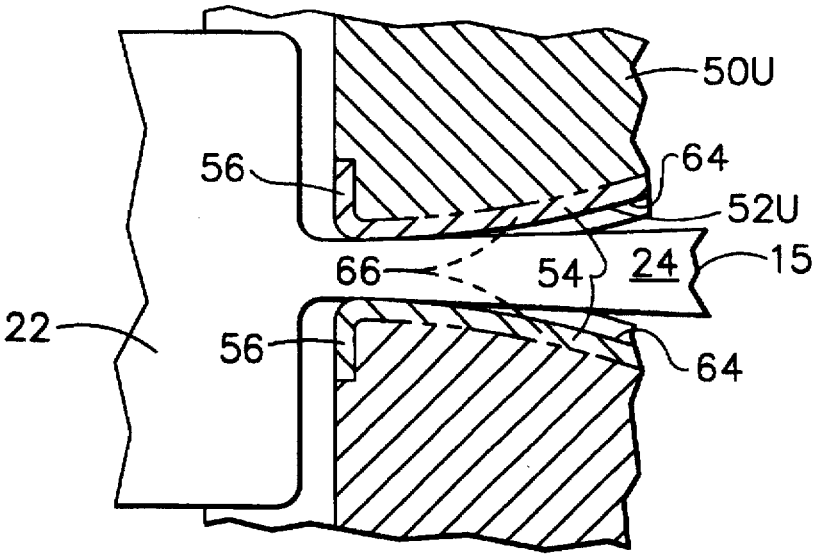
FIG. 2 is an enlarged view of a portion of the die and blade blank in FIG. 1.
Figure 3:
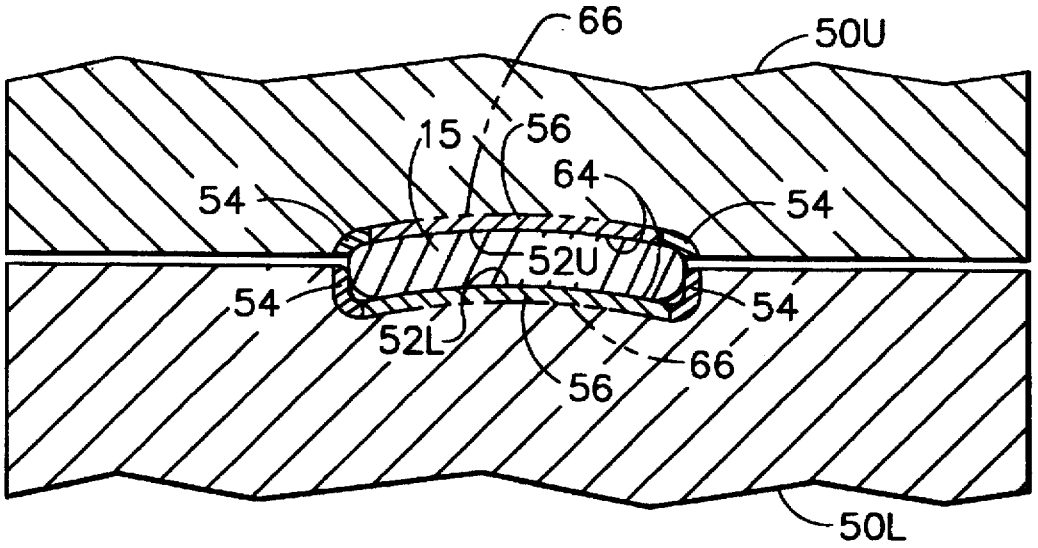
FIG. 3 is a cross-sectional view through the die and blade taken along line 3—3 in FIG. 1.
Figure 4:
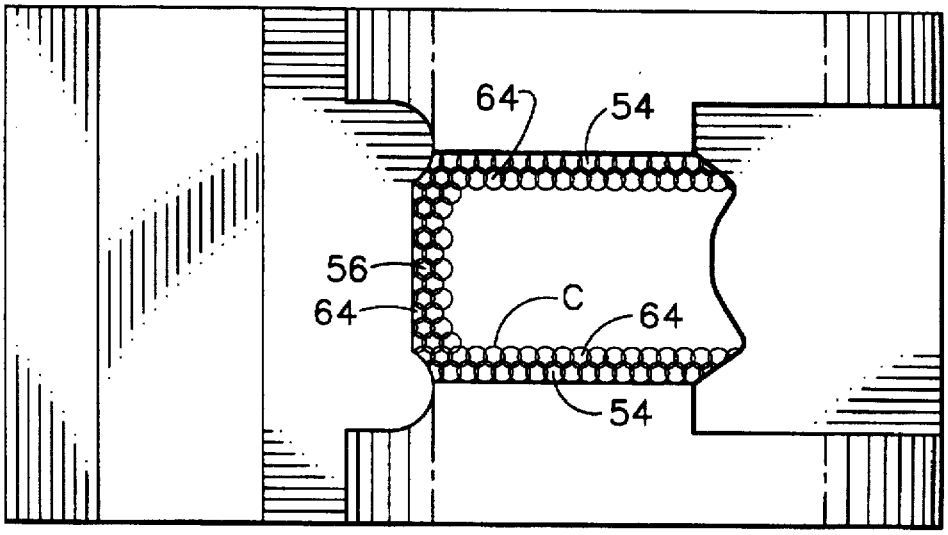
FIG. 4 is a cross-sectional view through the die and blade taken along line 4—4 in FIG. 1.
Figure 5:
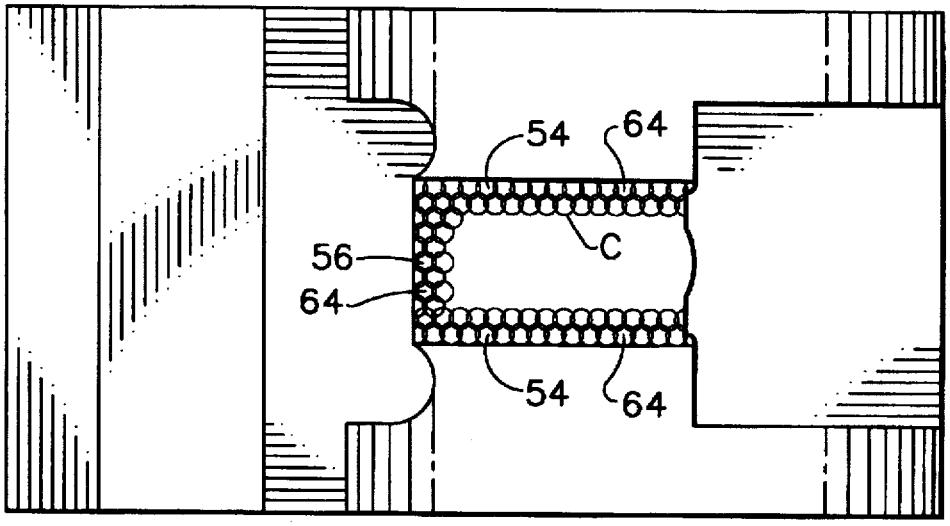
FIG. 5 is a cross-sectional view through the die and blade taken along line 5—5 in FIG. 1.

Illustrated in FIG. 1 is a pinch and roll die assembly 10 having upper and lower dies 12 and 14, respectively that may be used to form a blade blank 15 into an airfoil 16 of a conventional aircraft gas turbine engine compressor blade 20 which is illustrated in FIG. 1A. The blade blank 15 includes a root portion 22 and an airfoil portion 24. The airfoil 16 is formed from the airfoil portion 24 of the blade blank 15 by cold rolling the airfoil portion between the upper and lower dies 12 and 14 in accordance with the present invention. A root 28 of the blade 20 is later cut or broached from the root portion 22 of the blade blank 15.

The compressor blade 20 typically includes the airfoil 16 extending from a blade base 30 to a blade tip 31. The airfoil 16 extends longitudinally outward from a blade platform 32 at its base 30 and the root 28 extends longitudinally inward from the platform. The reference to longitudinally inward and outward corresponds to radially inward and outward in a gas turbine engine having a centerline as its radial origin. The blade 20 also includes a longitudinally extending leading edge LE and a longitudinally extending trailing edge TE which are transversely located opposite to each other on the blade. A pressure side 46 of the airfoil 16 faces in the general direction of rotation as indicated by the arrow and a suction side 48 is on the other side of the airfoil.

The upper and lower dies 12 and 14 of the die assembly 10 have upper and lower metallic roll blocks 50U and 50L with upper and lower depressions 52U and 52L, respectively, which are further illustrated in FIGS. 2–5. The upper and lower depressions 52U and 52L correspond to the suction and pressure sides 48 and 46 of the airfoil 16, respectively. Each of the upper and lower depressions 52U and 52L, respectively, have edges that include longitudinally extending cross-sectional transition zone 54 which are transversely located opposite to each other and correspond to the longitudinally extending leading edge and trailing edges LE and TE, respectively. The upper and lower depressions 52U and 52L may also have a transversely extending cross-sectional transition zone 56 which corresponds to the blade base 30.

To counter fatigue failure of the dies due to cracks that can develop and emanate from within the longitudinally extending and transversely extending cross-sectional transition zones 54 and 56, respectively, the present invention provides laser shock peened surfaces 64 encompassing at least a portion of each of the zones and a region 66 having deep compressive residual stresses imparted by laser shock peening (LSP) extending into the dies from the laser shock peened surface. The present invention produces the laser shock peened surfaces 64 with laser beam induced shock waves generally indicated by overlapping laser shock peened circular spots indicated generally by overlapping circles labelled C in FIGS. 4 and 5. The die has been found to be useful for cold rolling blanks such when the metallic block is a cold rolling die block.

The laser beam shock induced deep compressive residual stresses in the compressive pre-stressed regions 66 are generally about 50–150 KPSI (Kilo Pounds per Square Inch) extending from the laser shock surfaces 64 to a depth of about 20–50 mils into laser shock induced compressive residually pre-stressed regions 66. The laser beam shock induced deep compressive residual stresses are produced by repetitively firing a high energy laser beam that is focused on surface 64 which may be covered with paint to create peak power densities having an order of magnitude of a gigawatt/$cm^2$. The laser beam is fired through a curtain of flowing water that is flowed over the surface 64 and the paint is ablated generating plasma which results in shock waves on the surface of the material. These shock waves are re-directed towards the painted surface by the curtain of flowing water to generate travelling shock waves (pressure waves) in the material below the painted surface. The amplitude and quantity of these shock waves determine the depth and intensity of the compressive stresses. The paint is used to protect the target surface and also to generate plasma. Ablated paint material is washed out by the curtain of flowing water. It is also possible to not use paint. These and other methods for laser shock peening are disclosed in greater detail in U.S. Pat. No. 5,492,447, entitled "LASER SHOCK PEENED ROTOR COMPONENTS FOR TURBOMACHINERY" and Ser. No. 08/362,362, entitled "ON THE FLY LASER SHOCK PEENING", which are both incorporated herein by reference.

While the preferred embodiment of the present invention has been described fully in order to explain its principles, it is understood that various modifications or alterations may be made to the preferred embodiment without departing from the scope of the invention as set forth in the appended claims.

We claim:

1. A die comprising:

a metallic block having a depression, said depression having at least one cross-sectional transition zone, at least one laser shock peened surface encompassing at least a portion of said zone, a region having deep compressive residual stresses imparted by laser shock peening (LSP) extending into said metallic block from said laser shock peened surface.

2. A die as claimed in claim 1 wherein said metallic block is a cold rolling die block.

3. A die as claimed in claim 1 further comprising:

first and second laser shock peened surfaces encompassing at least portions of corresponding first and second cross-sectional transition zones, each of said zones located along one of opposite longitudinally extending edges of said depression, and first and second regions having deep compressive residual stresses imparted by laser shock peening (LSP) extending into said metallic block from said first and second laser shock peened surfaces.

4. A die as claimed in claim 3 further comprising:

a third laser shock peened surface located along a transverse portion of the die between said longitudinally extending edges, said third laser shock peened surface encompassing at least a portion of a corresponding third cross-sectional transition zone, and a third region having deep compressive residual stresses imparted by laser shock peening (LSP) extending into said metallic block from said third laser shock peened surface.

5. A die as claimed in claim 4 wherein the die is for forming a gas turbine engine component having an airfoil; the die further comprising:

said depression corresponding to an airfoil having longitudinally spaced apart airfoil base and tip transversely disposed between opposite longitudinally extending leading and trailing edges, said opposite longitudinally extending edges of said depression corresponding to said leading and trailing edges, and said transverse portion corresponding to said base.

6. A die as claimed in claim 5 wherein said metallic block is a cold rolling die block.

* * * * *